United States Patent [19]

Gustafson

[11] Patent Number: 4,719,935

[45] Date of Patent: Jan. 19, 1988

[54] PORTABLE MULTI-PURPOSE TENT ASSEMBLY

[76] Inventor: Stephen R. Gustafson, 149 Kachina Trail, Flagstaff, Ariz. 86001

[21] Appl. No.: 829,183

[22] Filed: Feb. 14, 1986

[51] Int. Cl.[4] ..... E04H 15/36; E04H 15/30

[52] U.S. Cl. ..... 135/102; 135/94; 135/95; 5/413; 52/DIG. 13

[58] Field of Search ..... 135/87, 102, 90, 95, 135/94; 5/413, 414, 512; 52/DIG. 13

[56] References Cited

U.S. PATENT DOCUMENTS

| | | | |
|---|---|---|---|
| 1,267,551 | 5/1918 | Jacobs | 5/413 |
| 1,289,965 | 12/1918 | Tichenor | 135/102 |
| 2,193,469 | 3/1940 | Ashton | 135/102 |
| 3,831,206 | 8/1974 | Geary | 5/413 |
| 4,068,428 | 1/1978 | Peterson | 52/DIG. 13 |

FOREIGN PATENT DOCUMENTS

| | | | |
|---|---|---|---|
| 104922 | 8/1938 | Australia | 135/87 |

*Primary Examiner*—J. Karl Bell

*Attorney, Agent, or Firm*—Charles P. Padgett, Jr.

[57] ABSTRACT

A tent-like apparatus which has a substantial portion of its roof cut out to form a roof opening. Fastener means are provided around the roof opening, and various types of inserts each having its own fastener about its peripheral edge and each being sized to be fitted within the roof opening and the two fastener portions releasably secured together. The roof opening may be uncovered to provide a direct view and air supply but relatively no protection from inclement weather, insects and the like. A first panel insert may include conventional tent material. A sheet of flexible transparent plastic material may be provided as an insert to provide a clear unobstructed view, protection from the effects of inclement weather, insects and the like, solar heating within the interior of the tent even in relatively cold weather so long as the sun is shining, and sufficient ultraviolet radiation to the tent interior to permit the occupant therein to obtain a suntan in any type of sunny weather. Lastly, a mesh-like screen panel insert may be employed to provide a somewhat reduced view, to keep out insects, and to allow the air in.

6 Claims, 7 Drawing Figures

PORTABLE MULTI-PURPOSE TENT ASSEMBLY

BACKGROUND OF THE INVENTION

1. Field of the Invention

The present invention relates generally to tent apparatus, and more particularly to tent apparatus which can serve multiple functions, such as protecting the interior of the tent from the effects of inclement weather and insects, providing a solar-heated tent even in relatively cold but sunny weather, providing a tent with a large viewing area and converting a tent into a sun-tanning booth, as desired.

2. Description of the Prior Art

For many years tents and various tent-like shelters have been made from canvas, nylon, or some similar material which is normally impervious to the effects of the weather, insects, and the like.

While some such prior art tents employed mesh-like screens over the windows and doors, these were simply used to let in air and prohibit the entry of insects and the like and were normally permanently installed with a canvas or nylon layer attached as a flap over the screen which could be closed to keep out rain and the like.

None of these prior art tents were provided with openings in the roof portion, where the roof openings are screened or adapted to remain open to let in light and air and to provide a view while providing a multi-purpose function such as collecting heat or allowing sun tanning.

A tent-like sleeping bag cover was proposed in U.S. Pat. No. 2,931,373 by Larson. It was made of a mesh-like screen tent which was situated well over the sleeping bag area to provide a view of the heavens while admitting light and fresh air, but it was actually a screen tent-like structure over a sleeping bag which amounted to no more than a screen tent. There was no canvas or nylon material covering to keep out the elements, and it was therefore only useful on warm nights without inclement weather conditions.

Plastic sheeting was used by C. M. Chiaradonna in U.S. Pat. No. 4,086,674 as a dome for a lawn chair for shielding a person residing in the lawn chair from wind and cold but it's semi-permanently attached and not adapted to be replaced by some other covering. Furthermore, the patent specifically teaches that the plastic is chosen to shield the lounge user from the suns rays and not to serve as a solar heated tent or sun tanning enclosure. Similar patents using plastic to shield an interior from wind and weather include U.S. Pat. Nos. 2,166,832; 3,431,923; 3,670,750; and 4,086,674.

While others devised various solar heating structures such as U.S. Pat. Nos. 3,244,186 to T. D. Thomason et al; 3,082,780 to H. D. Macy; and 3,812,616, these patents teach only a plastic layer for heating the interior of a tent-like structure or the use of a reflective layer in conjunction with a transmissive layer for maximizing heating effect. None teach a plurality of covers for use dependent on weather conditions, the desires of the user, and the like.

Lastly, U.S. Pat. No. 4,320,744 issued to Eben V. Fodor on Mar. 23, 1982 for a Solar Heated Portable Structure which was formed by flexible walls having a solar radiation transmitting panel so the interior of the structure could be heated by solar radiation and act like a sauna. The transmitting panel can also be transparent to ultraviolet radiation so a person inside the structure can get sun-tanned. Similar steam bath or sauna structures are disclosed in U.S. Pat. Nos. 407,434 to Evans; 408,204 to Babbitt; 1,669,484 to Mowry; 1,772,219 to Kempton; 1,946,567 to Braunworth; 2,478,765 to Kim; 2,493,328 to Wandyak; 2,666,441 to Powers; 3,051,185 to Reynolds; 1,128,781 to Kirkham; 3,165,110 to Brooks; 3,271,786 to Joy; 3,453,786 to Rebarechk; 2,483,871 to Wilson; 3,812,616 to Koziol; 3,031,674 to Rand; and 4,161,180 to Tiger.

None of the above patents teach a combination of various interchangeable layers of canvas or nylon material; mesh-like screen material; transparent plastic material; or open air space which can be used in a tent or tent-like structure depending upon weather conditions and the like. Nearly all are single purpose or single function structures and some are not truly tents in the camping sense, but rather enclosures for obtaining a sun tan or the like which would not be suitable for use in any normal type of camping situation.

SUMMARY OF THE INVENTION

It is an object of the present invention to provide a portable multi-purpose tent having various roof inserts which can be used interchangeably depending upon weather conditions and the desires of the tent user.

It is another object of the present invention to provide a solar-heated tent structure which can be used even in very cold weather so long as the sun is shining.

It is still another object of the present invention to provide a tent structure which can be provided with a large removable roof portion which may or may not be covered by other materials to provide a view therethrough.

It is a further object of this invention to provide a roof insert comprising a sheet of plastic material transparent to the ultraviolet lights of the sun to enable the user within the interior of the tent to obtain a suntan even in cold but sunny weather.

It is yet another object of the present invention to provide a tent which can be used as a sun-tanning booth while protecting the person being sun-tanned from the effects or inclement weather and insects while providing a large viewing area.

It is still another purpose of the present inention to provide a novel method and apparatus for fastening an insert panel within, on, or over a the roof opening.

It is yet another object of the invention to provide a hook and loop fastener system wherein patches of hook and loop material are located at predetermined spaced distances apart with a fuzzy fill material disposed between spaced patches to avoid the alignment problem normally associated with fastening long strips of hook and loop material.

It is still a further object of the present invention to provide a sleeping bag or tent-like structure with a large opening over the top of the sleeping area in which the canvas or nylon covering can be removed to provide an open air inlet; to provide a space for inserting a mesh-like screen to keep out insects and the like; to provide a space for securing a plastic sheet of material for solar heating the tent and sun-tanning a person inside while simultaneously providing a panoramic view and preventing insects and the effects of inclement weather from entering the interior of the tent; and to provide a combination of these inserts such as a plastic layer over a screen mesh layer to somewhat reduce the incandescent rays of the sun entering the tent so that it is not as hot as it would otherwise be and so that the person tanning will not tan as quickly or possibly burn.

The present invention provides an improved portable tent comprising a closable roof opening covering a substantial portion of roof and/or the roof portion of the tent. A generally box-like lower tent portion includes a bottom surface, a pair of longitudinal side panels, a lower head end portion and a lower foot end portion. An upper tent portion integral with the lower tent portion and defining a tent interior therebetween includes means for forming a roof opening having opening-defining edge portions thereabout. Fastening means include first and second fastener portions adapted to be removably secured together and separated, the first fastener portion being operatively disposed about said edge portions. The invention further includes first, second and possibly even third insert means where each of the first, second and third insert means is different and distinct from one another and each is dimensioned for closing the defined opening. Each includes means for operatively coupling said second fastener portion about the outer periphery thereof such that each can be selectively secured to said first fastener portion within said opening and removed therefrom, as desired. The roof opening is such that it may be covered by said first insert means, have said first insert means removed and be covered by said second insert means, have said second insert means removed and be covered by said third insert means, and be covered by at least two of said first, second, and third insert means, as desired.

Typically, the first insert means includes conventional tent material such as canvas, nylon, or the like whereas the second insert means includes a mesh-like screen and the third insert means includes a sheet of transparent plastic material. When the first, second and third insert means are removed, the opening exposes the interior of the tent directly to the atmosphere to provide a substantial view while admitting air and light to the tent. When the layer of canvas material covers the opening, the tent functions as a normal tent to protect the occupants from the elements, light, weather, insects and the like. When the mesh-like screen is over the opening, it admits air and sunlight while presenting a view, but prevents insects from entering the tent. When the plastic layer is used to cover the opening, the interior of the tent is heated by the solar heating effect of the rays of the sun passing through the plastic material and the interior can be used as a sun-tanning booth if the transparent plastic material is transparent to the ultraviolet rays of the sun in the spectrum appropriate for tanning purposes. Furthermore, with the plastic layer in place, a wide view is presented while the interior is protected from inclement weather, insects and the like. Lastly, the plastic layer can be inserted over or under the mesh layer to reduce the amount of solar heating within the tent and to reduce the rate of tanning to prevent sunburn and the like.

The fastening means may include conventional zippers, velcro strips, or patches, snaps, buttons or the like, but small patches of hook and loop material and utilized in the preferred embodiment wherein the first fastener portion includes a plurality of patches of hook-like material spaced at predetermined locations from one another while the second fastener portion contains similar patches of loop material placed at identical distances apart with the intermediate space between adjacent patches being filled with a fuzzy fill material, insulating means, or sealing means so that when adjacent patches of hook and loop material are pressed together, the strips of fill material are drawn together and provide a substantially air-tight seal about the roof opening.

Therefore, the present invention provides a portable multi-purpose tent having a roof portion where the roof portion includes means for forming a substantial opening therein and said opening-forming means includes peripheral edge portions thereabout. A fastening means includes a first fastening portion operatively secured about the roof portion proximate the peripheral edge portions and the first portion may be releasably secured to the second portion for fastening purposes. A relatively flexible sheet of plastic means sized to fit within said opening is provided and the peripheral edges of sheet of plastic material include said second fastening portions about the peripheral edges thereof for relatively securing and removing said plastic material from within said opening for providing a solar heated tent even in cold but sunny weather, for enabling the tent interior to be used as a sun tanning booth, to provide a substantial view from the interior, and to keep out the effects of inclement weather, wind, and insects.

These and other objects and advantages of the present invention will be better understood from a review of the detailed description of the present invention, the claims, and the drawings which are listed briefly hereinbelow.

DETAILED DESCRIPTION OF THE INVENTION

Figure 1:
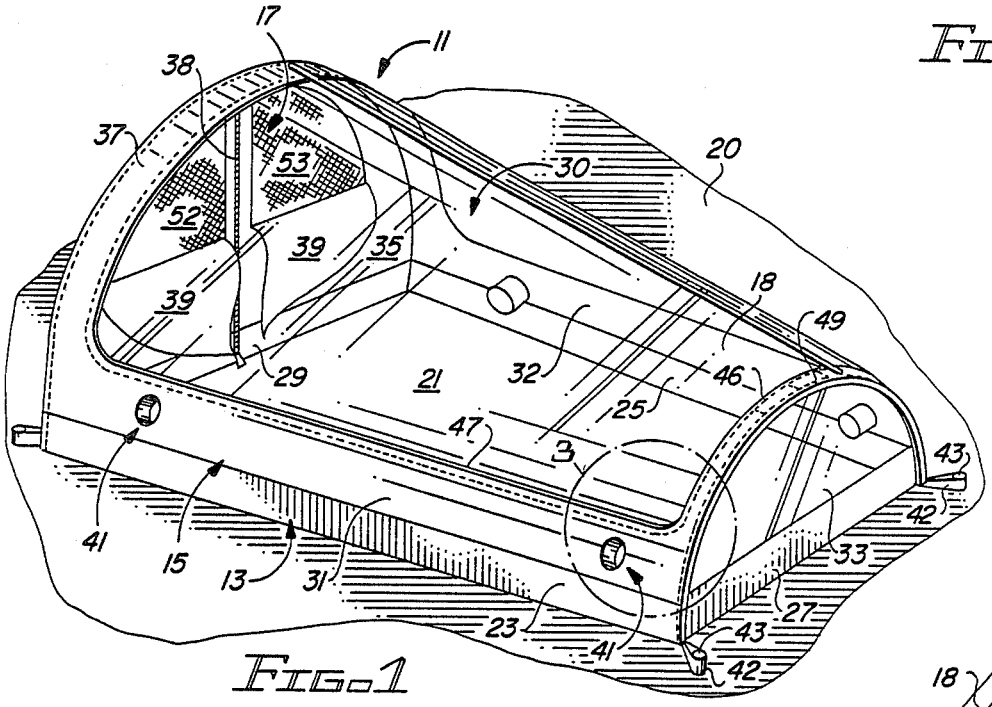
FIG. 1 is a perspective view of the portable multi-purpose tent assembly of the present invention.

FIG. 1 is a perspective view illustrating the portable multi-purpose or multi-functional tent-like assembly 11 of the present invention. The tent assembly 11 includes a lower tent portion 13 and an upper tent portion 15. The upper tent portion 15 includes a large roof opening or aperture 17 which may house or contain, for example, a plastic insert panel 18.

The lower tent portion is a generally box-like structure which includes a bottom or ground surface 21, a pair of elongated longitudinal side panels 23, 25, a lower foot end panel 27, and a lower head end panel 29.

The upper tent portion is integral with or attached to the lower tent portion for defining a tent interior 30. The upper tent portion includes a pair of elongated side panels 31, 32; an upper foot end panel 33; and an upper head end panel 35. The central roof opening 17 covers a substantial part of the roof portion of the tent 11 and has or is bounded by an outer peripheral edge which is defined or formed within the peripheral edge 47 of the upper longitudinal panels 31 and 32, the upper foot end panel 33 and the upper head end panel 35. Actually the upper foot end panel 33 has a relatively narrow, outwardly curved roof portion 49 whose peripheral edge 47 defines the outer edge 46 of the opening 17. Similarly, the upper head end panel 35 includes a relatively narrow, outwardly curved roof portion 37 which defines the heat end of the opening 46 at the peripheral edge 47.

A zipper or similar conventional fastening means 38 extends vertically down the upper head end panel 35 and at least partially through the lower head panel 29. A pair of flaps 39 made of the tent material itself, such as canvas, nylon, or the like, may be used to cover the window screen portions 52, 53, as known in the art.

Figure 2:
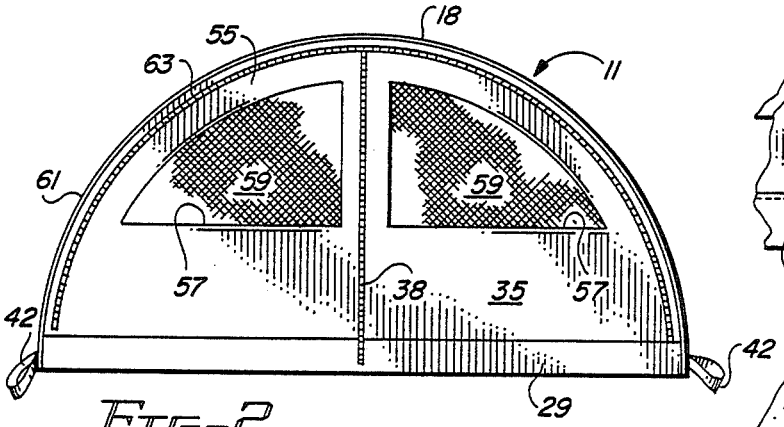
FIG. 2 is a left head view of the tent apparatus of FIG. 1.

FIG. 2 shows the head end portion of the tent assembly 11 including the lower head end portion or panel 29 and the upper head end portion 35 which includes a panel portion 55 having a pair of apertures 57 cut therein with the apertures covered by mesh-like screen members or windows 59 to admit air while keeping out insects. As shown in FIG. 1, when inclement weather arrives such as rain, snow, or high winds, the flaps 39 may be closed over the screen portions 59 of the windows 57 to block out the light, the inclement weather, insects and the like. The vertically disposed zipper 38 runs vertically down the panel 55 and may be used to enter or leave from the interior 30 of the tent assembly 11, as known in the art. The tent is provided with tent stake loops 42, each adapted to receive a tent stake 43 therein for securing the bottom portion of the tent to the ground 20 as known in the art.

In FIG. 2, the outer layer of canvas, nylon or similar tent material is designated by reference numeral 61 and that portion shown about the rim of the outwardly curved portion 37 is shown with the inner side secured to one half of a fastener means 63 which may be one half of a conventional zipper, hook and loop fastener pair, male and female snap assembly, or the like. The opposite half of the fastener assembly 63 is fastened to the outer peripheral edge of the panel 55 so that the entire head end portion 35 can be selectively opened for further ease of egress into and out of the tent interior 30.

Figure 3:
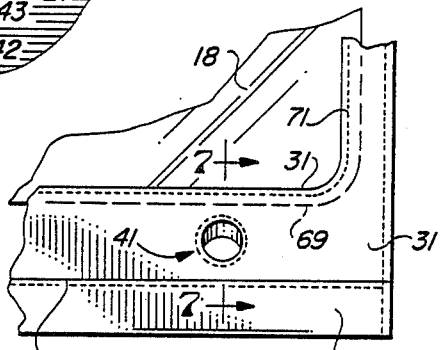
FIG. 3 is a sectional, blown up view of that portion of the tent assembly of FIG. 1 shown within the circle designated by reference number 3.

FIG. 3 illustrates a section of the tent assembly of FIG. 1 illustrated within the circular portion designated by reference numeral 3. In FIG. 3, the elongated lower side panel 23 is shown as being sewn or otherwise fixedly attached to the upper panel 31 by conventional thread or stitches 65. The air vent 41 is shown as providing an air duct into and out of the tent interior 30 as hereinafter described. The outer peripheral edge 67 of the panel 31 is shown as being fixedly attached by means of stitches 71 or the like to the outer peripheral edge 69 of the transparent window insert panel 18.

Figure 4:
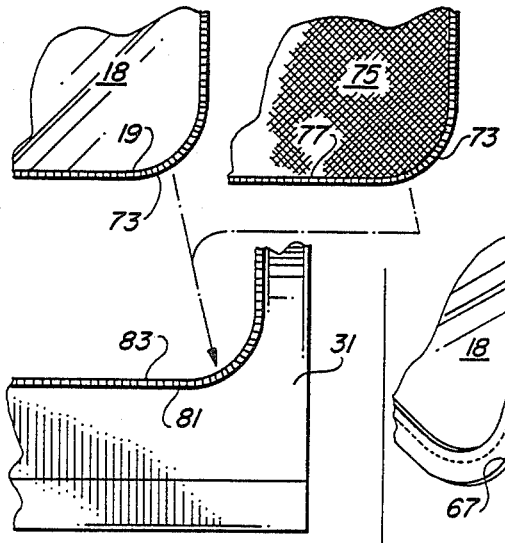
FIG. 4 is a view showing the fastening means for attaching the various panel inserts into the roof opening in the present invention.

FIG. 4 shows another embodiment for attaching a window insert within the opening 19 whereby a plastic insert panel 18 has its outer peripheral edge provided with one half of a zipper fastener means 73 while a second insert, such as a mesh-like screen insert 75 has its outer peripheral edge 77 fixedly secured to a first half of a similar zipper fastening device 73. It will be understood, however, that the fastening device may include one half of a zipper, one half of a hook and loop pair or set of patches, one half of a male and female snap combination, or any similar fastening means known in the art. Both of the roof inserts are adapted to be selectively attached to and separated from the second half of the fastener means or zipper 83 which is operably disposed or secured to the outer peripheral edge 81 of the upper side panel 31 such that any of the inserts can be positioned over the roof window aperture and attached to the outer peripheral edge of the upper panel 31 defining the opening, as desired.

In fact, a first insert could be adapted for fastening into the roof opening and could be made from conventional canvas, nylon, or similar tent material for enabling the portable multi-purpose tent assembly of the present invention to be used as a conventional tent with the tent panel insert keeping out the light, keeping out insects and inclement weather such as rain, wind, snow and the like. Alternatively, the tenting material insert can be removed and replaced by a mesh-like screen insert to provide protection from the outside elements for providing a view from the roof opening, and for permitting fresh air to enter the tent.

Thirdly, a relatively thin flexible sheet of plastic material, preferably transparent to solar radiation in the wavelengths suitable for tanning the human body can be used to cover the opening so as to provide a portable multi-purpose tent assembly which can be used in extremely cold weather so long as the sun is shining since the effect of the solar transmissive plastic covering will act as a solar heater to increase the temperature within the interior of the tent to acceptable levels. Alternatively, the plastic layer could be used in warm or cool weather when camping, or when simply placed on the patio, on a roof top, in the garden or the like to provide privacy, while the occupant of the interior of the tent receives a sun tan from the ultraviolet rays of the sun passing through the transparent plastic material. Simultaneously, of course, plastic material keeps out the adverse effects of the weather including wind, rain, and snow and also serves to prevent insects from entering the interior while providing a spacious view from within the tent.

Lastly, all inserts could be removed, leaving an open roof window for a wide view and air but relatively no protection from the elements.

Figure 5:
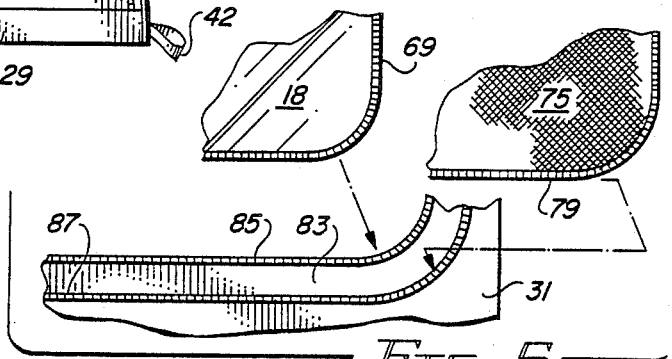
FIG. 5 is a plan view showing a double fastener portion for attaching two inserts panels into the roof opening of the tent assembly of FIG. 1.

FIG. 5 illustrates an alternate embodiment wherein a first and second insert panel, for example, a plastic layer 18 having a peripheral fastener 69 and a second panel such a a mesh-like screen 75 having a periphery fastener 79 can be attached to two separate and corresponding fastener portions 85 and 87, respectively, so that two panels at once can be spaced into the roof aperture for covering the opening or window. A space of the canvas, or tent material 83 is disposed between the adjacent second halves of the fastener means 81 and 82 so that either can releasably engage fasteners 69 and 79 of the plastic panel, screen panel, or tent-like material panel, as desired. It may be desirable, for instance, to insert the mesh-like screen over the plastic-like material 18 or under the plastic-like material 18 to slightly reduce the solar heating effect within the tent interior on warmer days while still providing sun tanning, heating, protection from the elements and insects, and a view. Simultaneously, reversing the two-mesh-like screen 75 and the plastic sheet 18 can also be used for the same purpose. Further, the screen and plastic combination will reduce the tanning rays reaching the person within the tent to prevent burning or too rapid a sun-tanning.

Figure 6:
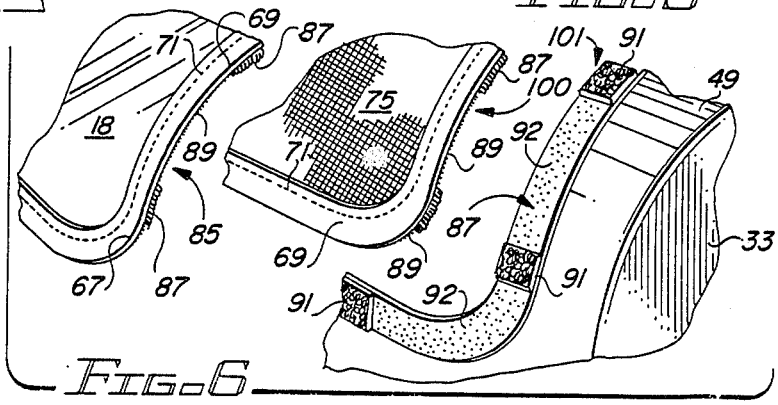
FIG. 6 is a broken away sectional view showing patches of hook and loop fasteners employed to fasten the inserts to the peripheral edges of the roof opening of the tent apparatus of FIG. 1.

FIG. 6 shows an alternative attachment system using spatially separated or spaced patches of hook and loop material. A first insert panel, such as plastic insert panel 18, is shown as having its outer peripheral edge 69 sewn or secured via stitches 71 to top surface 67 of fastener means 85. The fastener means 85 includes a plurality of spaced patches, swatches, or portions of one of either a male hook-like portion or a female loop-like portion 87. The patches of such material are spatially separated longitudinally by a predetermined distance and the portion between adjacent patches 87 are provided with a strip of fill material 89 such as a fuzzy open weave fabric or wool-like substance, an insulating material, a filling material, or the like.

Similarly, a second screen panel 75 has its outer peripheral edge 69 sewn by stitches 71 or otherwise secured to a fastening means 100 which includes a plurality of spatially separated patches or male hook-like fastener material or female loop-like fastener material 87 as described above with respect to the plastic insert panel 18. Similarly, the longitudinal space separations are provided with fill material 89 between adjacent swatches.

The arcuate, convexly shaped, outwardly curved portion 49 of the foot end panel 33 has its inner peripheral edge defining the foot end of the roof opening 17 has attached to it a strip of fastener material 101. Fastener material 101 includes a plurality of corresponding patches or swatches 91 of the opposite of the male hook-like fastener members and female loop-like members of the plastic panel 18 and screen panels 75, and the female loop-like fastener means of the corresponding plastic panel 18 and screen panel 75, such that the material of the patch portion 87 is adapted to physically engage the material of the patch portion 91 and form a releasable attachment therebetween for fastening purposes, as conventionally known in the art. Similarly, a strip or length of fill material 87 is disposed intermediate adjacent longitudinal patches 91 and the spacing distances 93 is equal on the tent portion and on the insert portion so that only the patches have to be pressed together thereby eliminating the problem normally inherent in trying to align relatively long strips of hook and loop-type fastener material.

The intermediate segments of fill material, which may be as much as a foot long, in one embodiment, provide easy attachment at the patches 87, 91. The reinforced edge portions provided with the fastener strips 85, 100, or 101 will flex after the attachments of the insert causing the two fill surfaces to pull toward one another as tension is applied by staking or opening the tent or by the flex of the tent poles. The fill material then acts as an air block or seal between adjacent hook and loop patches providing a substantially air-tight seal between the roof insert and the tent roof.

Figure 7:
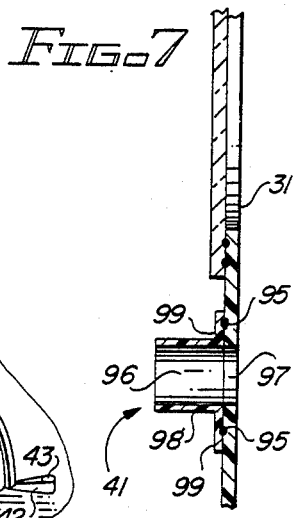
FIG. 7 is a sectional side view of an air vent of the tent apparatus of FIG. 1.

FIG. 7 illustrates an upper side panel 31 having an aperture 97 therethrough. A generally hollow cylindrical portion 98 having a pair of laterally extending ears 99 is provided such that the ears may be attached by welds 95 or the like to the tent fabric 31. The aperture 97 through the tent fabric 31 communicates with the hollow interior of 96 of the cylindrical portion 98 of the air vent 41. The air vent 41 can be provided with draw strings or the like passing through the walls 98 so that the air coming into or leaving or being exhausted from the interior 30 of the tent can be selectively controlled by pulling the drawstrings tight or loosening the drawstrings, as required. It will be noted, that FIG. 7 also shows that one roof insert panel, such as the plastic material 18 may be welded via welds 95 to the upper peripheral edge of the tent material 31 for a permanent bond, if desired. It would of course be possible to provide for attaching a screen insert, or a solid tent material insert over the permanent plastic layer, as desired, and in accordance with the teachings with FIG. 5 of the present invention.

With this detailed description of the specific apparatus used to illustrate the preferred embodiment of the present invention and the operation thereof, it will be obvious to those skilled in the art that various modifications changes, variations, and substitutions can be made in the structure shown, in the fastening means used, in the type, size and location of the window insert, and the like without departing from the spirit and scope of the present invention which is limited only the appended claims.

What I claim is:

1. A multi-purpose, portable, tent-like structure comprising:

a generally box-like lower tent section including a generally rectangular bottom adapted to be operatively disposed substantially horizontally on a ground surface, a pair of generally rectangular, substantially upright, longitudinal side panels, a generally rectangular, substantially upright lower head-end panel adapted to serve as the head of said tent-like structure, and a generally rectangular, substantially upright, lower foot-end panel adapted to serve as the foot of said tent-like structure, said bottom having an outer peripheral edge portion, said generally box-like lower tent section comprising a generally rectangular box-like configuration with a substantially horizontal bottom and substantially vertical side panels and end panels extending upwardly from the outer peripheral edge portions of said bottom, each of said panels having the top edge portion;

an upper tent section at least one of integral with and fixedly attached to the upper edge of said lower tent section, said upper tent section including a pair of upper longitudinal side panels having a bottom edge of at least one integral with and fixedly attached to the corresponding top edge of a corresponding lower longitudinal side panel, and a top edge, said pair of upper longitudinal side panels being oriented substantially vertically upward from said lower longitudinal side panels and being curved a predetermined distance inwardly toward one another, a generally semi-circular foot-end panel having its diameter at least one of integral with and fixedly secured to the top edge of said lower foot end panel and the semi-circular curved portion extending substantially vertically upward therefrom and substantially coplanar therewith, a generally semi-circular head end portion having its diameter at least one of integral with and fixedly attached to the top edge of said lower head end portion and the semi-conductor curved portion extending substantially vertically upright therefrom and substantially coplanar therewith, the radius of the semi-circular curved portion of said head end panel being greater than the radius of the semi-circular portion of the foot end portion, each of said upper panels having a top edge portion, a generally inwardly facing framing means having an outside edge portion at least one of integral with and fixedly attached to the top edge portions of said upper panels and an interior edge extending a predetermined distance inwardly therefrom for forming a roof opening extending substantially the entire longitudinal length of said tent-like structure from said head end portion to said foot end portion;

at least first and second fastening means, each of said fastening means including first and second fastening portions adapted to be removably secured and unsecured from one another, each of said first fastening portions being operatively secured to the inwardly facing edge portions of said framing means for forming said roof opening;

first roof insert means;

second roof insert means;

third roof insert means;

each of said first, second, and third roof insert means being different and distinct from one another, each being dimensioned for fitting within and substantially closing said framed roof opening and each including an outer peripheral edge portion to which said second fastening portion of each of said fastening means is attached thereto such that each of said insert means can be selectively mounted in and removed from said roof opening by attaching a corresponding first fastening portion which is attached to the interior edge portion of said framing means to a corresponding second fastening portion secured about the outer peripheral edge portion of said insert;

said roof opening being exposed to the atmosphere when none of said insert means are operatively secured therein for admitting air and providing a substantial view therethrough;

said roof opening being closed by at least one of said first, second and third insert means for forming a multi-function tent-like assembly;

said first insert means including a generally flexible sheet of tent material formed as a truncated portion of a conical section that is adapted for keeping out the light, keeping out insects, and keeping out inclement weather;

a second roof insert means including a generally flexible sheet of transparent plastic material formed as a truncated portion of a conical section and adapted for heating the interior of the tent-like structure by solar energy, even in cold weather, provide the sun is shining; enabling the interior of the tent to be used as a sun-tanning closure; providing the occupant of the tent interior with a wide angle view therefrom; and preventing the admission of insects and the effects of inclement weather;

said third roof insert means including a generally flexible sheet of mesh-like screen material formed as a truncated portion of a conical section and adapted to provide protection from the outside elements, and permit fresh air to enter the tent, and permit a relatively good view from the interior thereof.

2. The multi-purpose, portable, tent-like structure of claim 1 wherein said first and second fastening portions of each of said first and second fastening means include patches of male hook portions and female loop portions, respectively, and wherein said patches are separated by predetermined length strips of fill-type material means for effectively sealing the roof opening when said spaced patches are removably joined thereto.

3. The multi-purpose, portable, tent-like structure of claim 1 wherein each of said first and second fastening means includes a first and second corresponding zipper portion and wherein said first and second fastening portions of each of said first and second fastening means includes the corresponding cooperating zipper portion.

4. A portable tent comprising:

an elongated, generally box-like tent portion having a bottom, a pair of inwardly curved longitudinal side panels, a generally semi-circular head end panel and a generally semi-circular foot end panel;

said box-like tent portion having an elongated, outwardly curved, open roof portion at least one of integral with and fixedly attached to said box-like tent portion for defining a hollow tent interior therebetween;

roof opening means operably disposed within said roof portion and covering substantially the entire length thereof from said head end panel to said foot end panel, said roof opening means including a pair of flange members having inwardly disposed outer peripheral edges about said roof opening;

first and second fastening means each including a first fastening portion operatively disposed about each of said flange members and a second fastening portion adapted to relatively engage and disengage said first fastening portions;

a first single unitary insert means including a substantially transparent sheet of relatively thin flexible plastic material means adapted to be operatively secured within said roof opening for passing the ultraviolet rays of the sun therethrough for heating the interior of said tent by solar energy means even in cold but sunny weather for enabling the interior of said tent to be used as a sun-tanning booth, for providing an unencumbered view from said interior of said tent, and for protecting the occupant's of the interior from insects and the effects of inclement weather;

a second single unitary insert means including a relatively flexible sheet of screen-like mesh material means adapted to be operatively secured within said roof opening means for protecting the inhabitants of the tent from insects, for providing a view through the roof, and for slightly reducing the amount of sunlight passing therethrough;

a third single unitary insert means including a relatively sheet of tent-like material means adapted to be operatively secured within the roof opening means for preventing light from entering the hollow interior of the tent, for protecting the inhabitants of the tent from insects, for protecting the inhabitants of the tent from inclement weather, and for providing privacy for the inhabitants of the tent;

each of said insert means being sized to fit within said roof opening means and including an outer peripheral edge portion adapted to have attached thereto said second fastening portion of said fastening means thereby enabling each of said insert means to be removably inserted into and taken from said roof opening.

5. The portable tent of claim 4 wherein said first and second fastening portions include first patches of spatially separated male hook-like means and second spatially separated patches of female loop-like means, the spatial separations between adjacent ones of said patches on said first fastening portion being equal to the spacing between adjacent patches on said second fastening portion, said opposing patches being brought together and separated for operatively selectively attaching said insert means to and removing said insert means from said aperture means.

6. The portable tent of claim 5 wherein said fastening means further includes segments of fill-type means operatively disposed between the patches of said first and second fastening portions for eliminating the problems of trying to align long strips of hook and loop material and for substantially sealing the insert means within said aperture means in a relatively airtight manner.

* * * * *